US007444967B2

(12) United States Patent
Kido et al.

(10) Patent No.: US 7,444,967 B2
(45) Date of Patent: Nov. 4, 2008

(54) VARIABLE VALVE DEVICE FOR INTERNAL COMBUSTION ENGINE

(75) Inventors: Yusuke Kido, Okazaki (JP); Shinichi Murata, Okazaki (JP); Masaru Mori, Nagoya (JP); Kenta Kotsuji, Uji (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/723,122

(22) Filed: Mar. 16, 2007

(65) Prior Publication Data

US 2007/0215082 A1 Sep. 20, 2007

(30) Foreign Application Priority Data

Mar. 17, 2006 (JP) ..... 2006-074579
Mar. 28, 2006 (JP) ..... 2006-088976

(51) Int. Cl.
*F01L 1/34* (2006.01)

(52) U.S. Cl. ..... 123/90.16; 123/90.15; 123/90.31; 123/198 F

(58) Field of Classification Search ..... 123/90.16
See application file for complete search history.

(56) References Cited

U.S. PATENT DOCUMENTS 5,460,130 A * 10/1995 Fukuzawa et al. ..... 123/90.16
5,845,614 A * 12/1998 Tanaka et al. ..... 123/90.16
7,007,646 B2 * 3/2006 Takayasu et al. ..... 123/90.16
7,107,953 B2 * 9/2006 Takayasu et al. ..... 123/90.39

FOREIGN PATENT DOCUMENTS

JP 2005-90408 A 4/2005

* cited by examiner

*Primary Examiner*—Thomas Denion
*Assistant Examiner*—Kyle M Riddle
(74) *Attorney, Agent, or Firm*—Birch, Stewart, Kolasch & Birch, LLP

(57) ABSTRACT

A variable valve device includes a camshaft which is rotatably provided in an internal combustion engine while having a cam, a rocker shaft which is arranged next to the camshaft, a valve which is driven by the cam, a cam follower rocker which is rotatably provided in the rocker shaft, and is rocked by following the cam, a valve drive rocker which is rotatably provided in the rocker shaft next to the cam follower rocker, and drives the valve, and a switching portion which be able to switch the valve drive rocker between a drive state and a non-drive state. Either a body of the cam follower rocker or a body of the valve drive rocker is made of an iron-based metal material, and the other body is made of a material different from the iron-based metal material, heat treatment being not required in the different material.

11 Claims, 8 Drawing Sheets

VARIABLE VALVE DEVICE FOR INTERNAL COMBUSTION ENGINE

CROSS-REFERENCE TO RELATED APPLICATIONS

This application is based upon and claims the benefit of priority from prior Japanese Patent Applications No. 2006-074579, filed Mar. 17, 2006; and No. 2006-088976, filed Mar. 28, 2006, the entire contents of both of which are incorporated herein by reference.

BACKGROUND OF THE INVENTION

1. Field of the Invention

The present invention relates to a variable valve device for an internal combustion engine, which controls a valve.

2. Description of the Related Art

A reciprocating engine mounted in an automobile is an example of an internal combustion engine. In some reciprocating engines, in order to achieve better mileage, the engine can be run in a cylinder-suspension mode in which some of the cylinders are suspended under driving conditions wherein a large output is not required.

In the running in the cylinder-suspension mode, frequent lifts of inlet and exhaust valves of the cylinder are stopped with variable valve devices to decrease pumping loss. That is, opening and closing of the valve are stopped.

Unlike the inlet valve, there are few demands for the exhaust valve that a valve lift amount and open-close timing are precisely controlled according to a running state of the engine. Therefore, in order to simplify the structure of a rocker shaft for stopping the exhaust valve lift, a rocker arm incorporated into the rocker shaft is divided into a cain follower rocker which follows a cam and a valve drive rocker which drives the valve. A displacement of the cam follower rocker is transmitted to or cut off from the valve drive rocker through a switching portion (for example, see Jpn. Pat. Appln. KOKAI Publication No. 2005-90408).

When the cam follower rocker and the valve drive rocker are connected to each other with the switching portion, the displacement of the exhaust cam is transmitted from the cam follower rocker to the exhaust valve through the valve drive rocker. When the cam follower rocker and the valve drive rocker are separated from each other by the switching portion, the cam follower rocker strikes the air for the valve drive rocker. Therefore, the displacement of the exhaust cam is not transmitted to the valve drive rocker.

Usually the two exhaust valves are tend to be used to enhance exhaust performance of the burned gas. Therefore, frequently a front-end side of an arm is branched in the valve drive rocker of the exhaust valve, and front-end portions of the branched arm are arranged in an upper end portion of the valve. This enables the two exhaust valves to be simultaneously driven (for example, see Jpn. Pat. Appln. KOKAI Publication No. 2005-90408).

In the divided-type rocker arm structure, frequently a body is formed by casting with an iron-based metal material such as steel because strength is increased.

Because the as-prepared iron-based metal material such as the steel has difficulty in the strength, usually machining is carried out to secure accuracy after quenching is carried out as heat treatment. Specifically, because the iron-based metal material for which the quenching is carried out has high hardness, the machining is carried out on the iron-based metal material not by cutting but by polishing.

In the case where both the cam follower rocker and the valve drive rocker are made of the steel, the cam follower rocker has a portion, to which a high impact load is imposed, including a region which receives the displacements of the cam and an abutment which abuts on the piston. Therefore, from the viewpoint of strength, the use of the steel for which the quenching is carried out is required.

On the other hand, the valve drive rocker has no portion to which the high impact load is imposed. Specifically, the load imposed on the piston is received by a wide area such as a portion in which the piston is accommodated. Therefore, such high strength is not required compared with the cam follower rocker, but instead the valve drive rocker has a portion for which high accuracy is required.

In the case where the cam follower rocker and the valve drive rocker are made of the steel, as with the cam follower rocker, the quenching and the polishing are carried out even on the valve drive rocker in which the product accuracy is emphasized, which results in the problem that machining man-hours are increased, leading to higher cost in the variable valve device.

SUMMARY OF THE INVENTION

In view of the foregoing, an object of the invention is to provide a variable valve device for an internal combustion engine, in which machining man-hours can be decreased.

A variable valve device of the present invention comprises: a camshaft which is rotatably provided in an internal combustion engine while having a cam; a rocker shaft which is arranged next to the camshaft; a valve which is driven by the cam; a cam follower rocker which is rotatably provided in the rocker shaft, and is rocked by following the cam; a valve drive rocker which is rotatably provided in the rocker shaft next to the cam follower rocker, and drives the valve; and a switching portion which be able to switch the valve drive rocker between a drive state and a non-drive state. Either a body of the cam follower rocker or a body of the valve drive rocker is made of an iron-based metal material, and the other body is made of a material different from the iron-based metal material, heat treatment being not required in the different material.

According to this structure of the invention, one of the body of the cam follower rocker or the body of the valve drive rocker is made of the iron-based metal material, and the other body is made of the different material for which the heat treatment is not required. Therefore, the heat treatment and the particular machining are eliminated.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
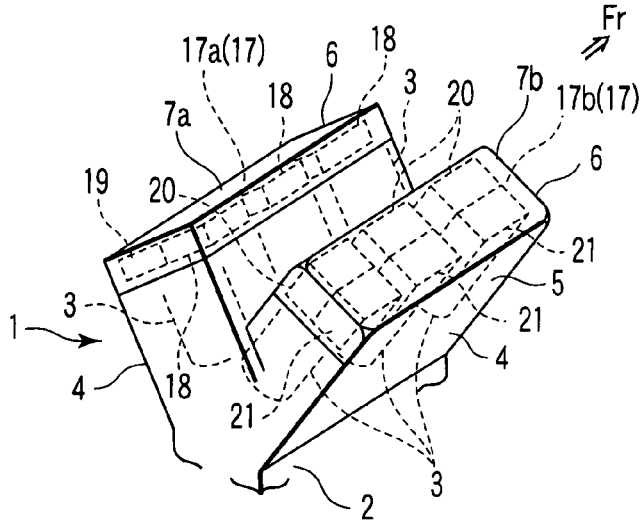
FIG. 1 is a perspective view showing an engine on which a variable valve device according to a first embodiment of the invention is mounted.
Figure 4:
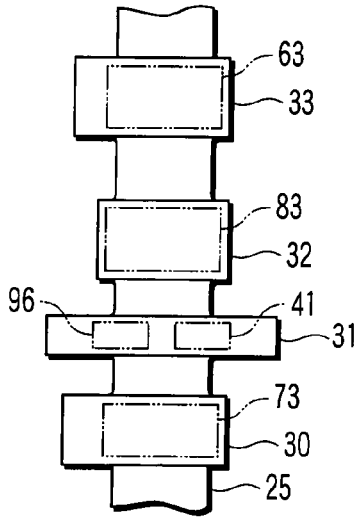
FIG. 4 is a plan view showing a layout of various cams of a camshaft.
Figure 3:
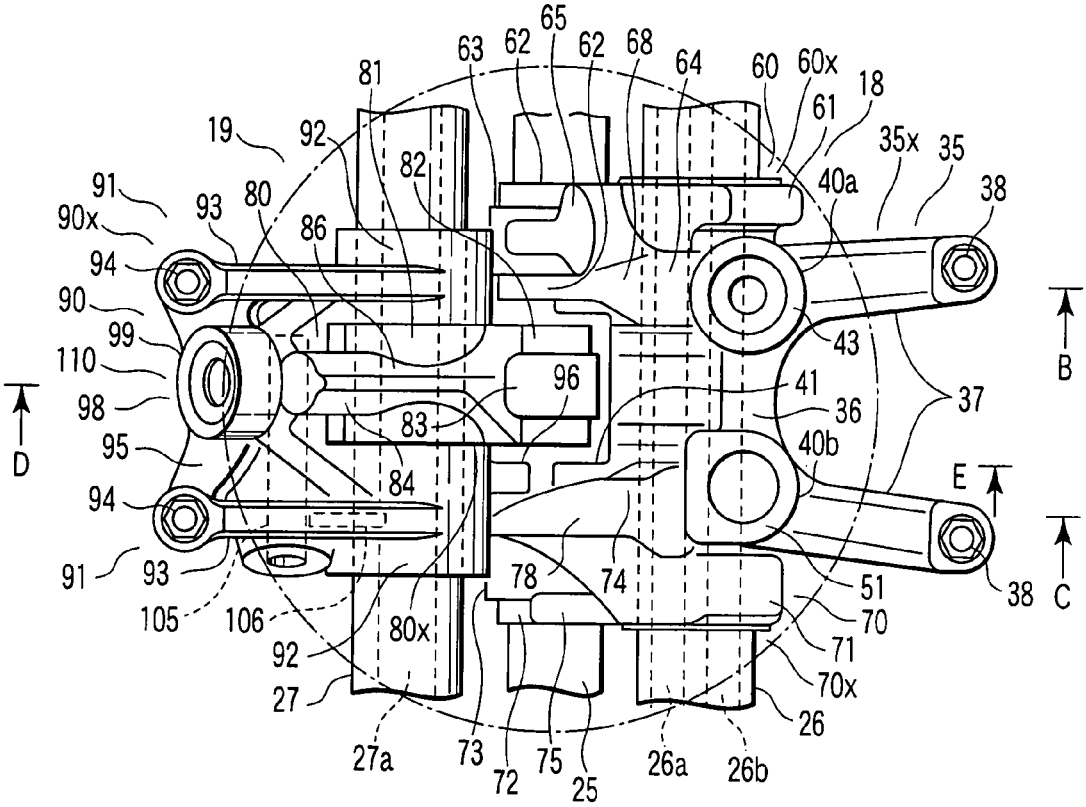
FIG. 3 is a plan view showing the inlet and exhaust variable valve devices of the one cylinder shown in FIG. 2 when viewed from an arrow A of FIG. 2.
Figure 2:
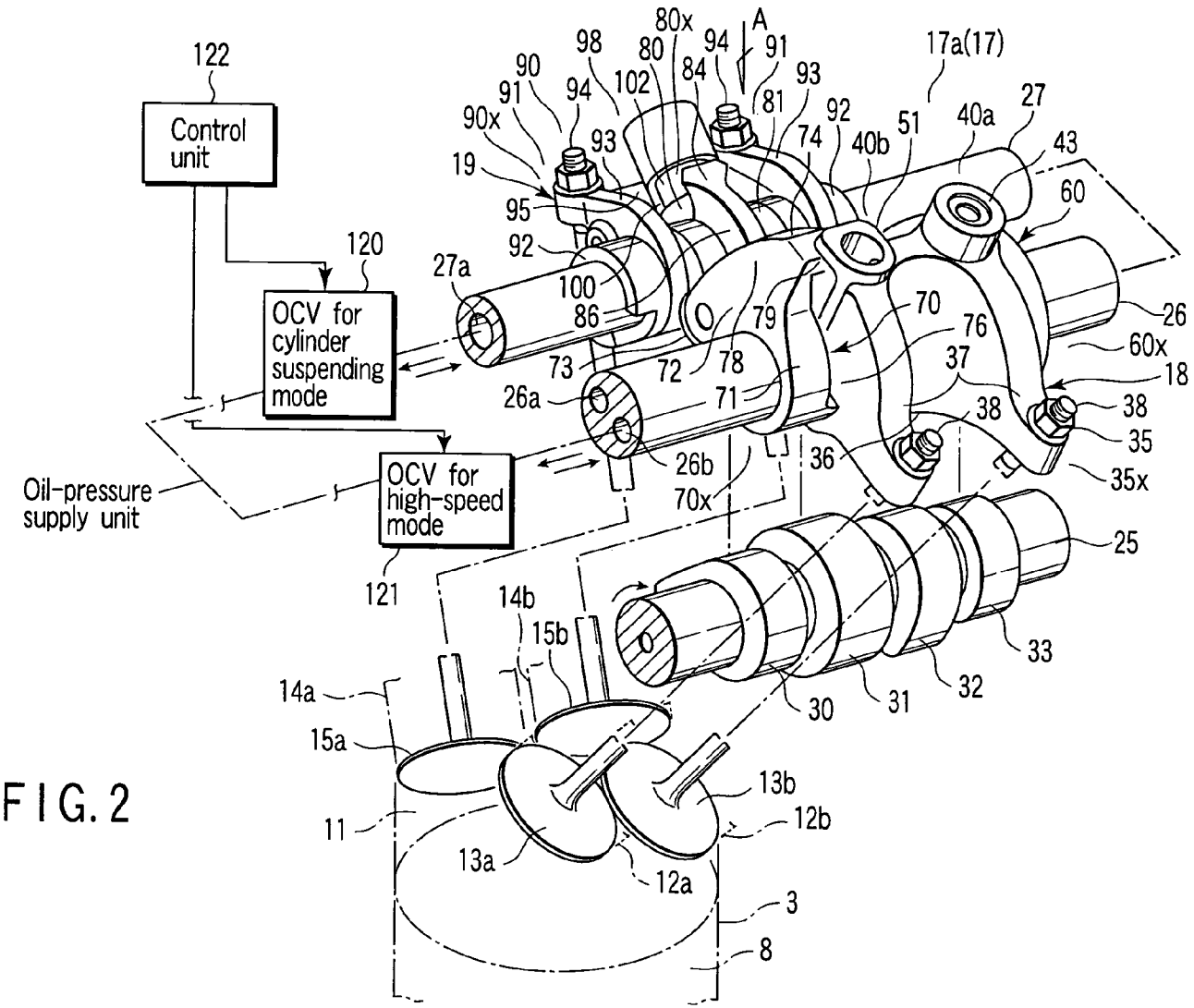
FIG. 2 is a perspective view showing the whole of both inlet and exhaust variable valve devices of one of cylinders mounted on a left bank of the engine shown in FIG. 1.
Figure 9:
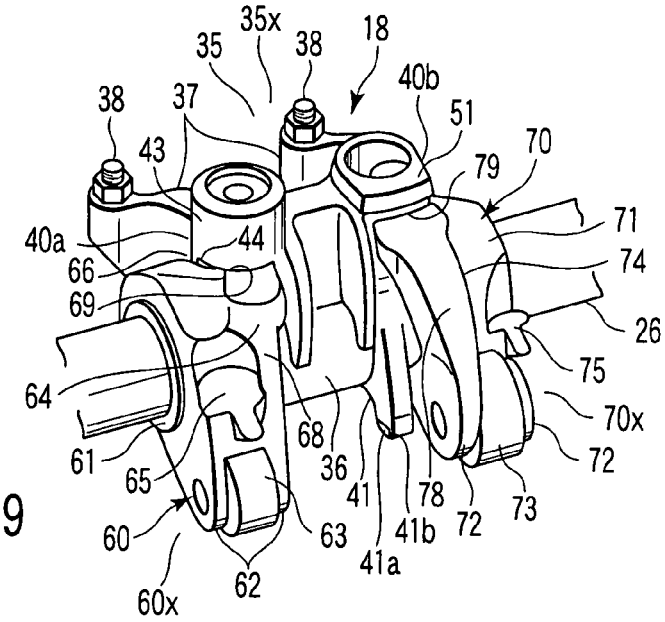
FIG. 9 is a perspective view showing the whole of the variable valve device on the inlet side.
Figure 10:
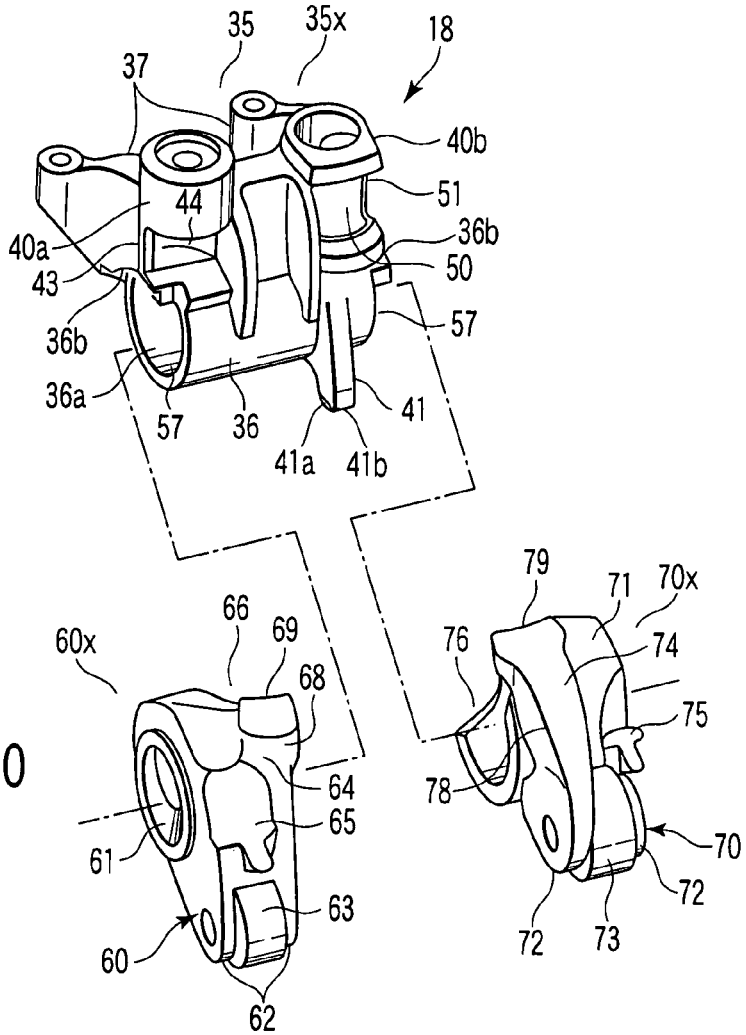
FIG. 10 is a perspective view showing a state in which the variable valve device on the inlet side is taken apart into a cam follower rocker and a valve drive rocker.
Figure 11:
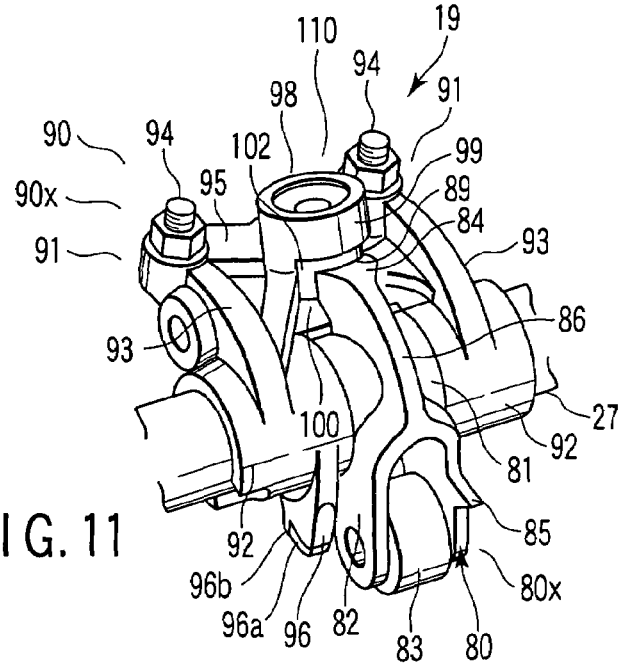
FIG. 11 is a perspective view showing the whole of the variable valve device on the exhaust side.
Figure 12:
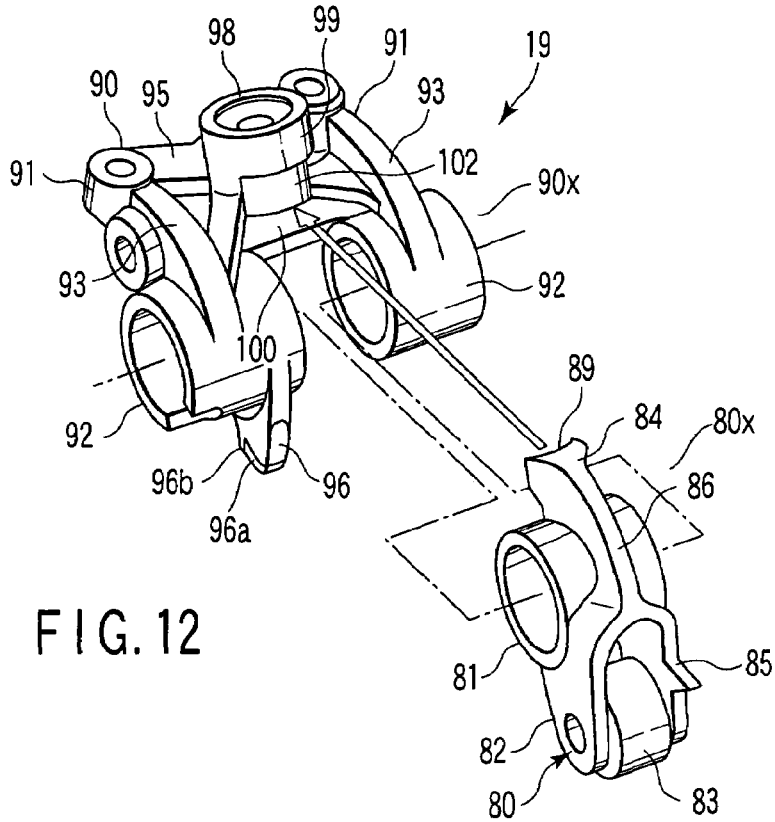
FIG. 12 is a perspective view showing a state in which the variable valve device on the exhaust side is taken apart into the cam follower rocker and the valve drive rocker.
Figure 13:
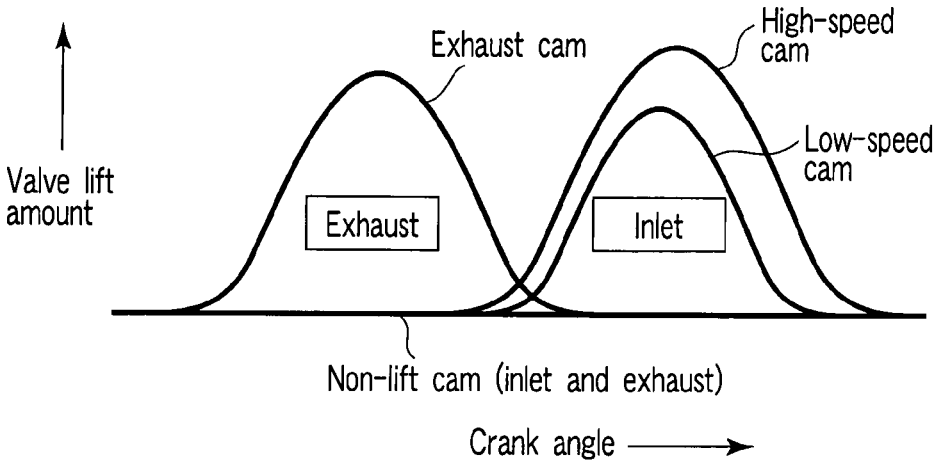
FIG. 13 shows states of various valve lifts provided by the inlet and exhaust variable valve devices.

A first embodiment of the invention will be described with reference to FIGS. 1 to 13. FIG. 1 is a perspective view showing an engine which is an internal combustion engine, e.g., a V-six reciprocating engine (hereinafter simply referred to as V-type engine) when viewed from behind. FIG. 2 is a perspective view showing a variable valve device for both inlet and exhaust valves of the engine. FIG. 3 is a plan view showing the variable valve device when viewed from an arrow A of FIG. 2. FIG. 4 is a plan view showing various cams of the variable valve device. FIGS. 5 to 8 are sectional views showing portions of the variable valve device when viewed from arrows B to E of FIG. 3. FIG. 9 is a perspective view showing the variable valve device on the inlet side. FIG. 10 is an exploded view of the variable valve device on the inlet side. FIG. 11 is a perspective view showing the variable valve device on the exhaust side. FIG. 12 is an exploded view of the variable valve device on the exhaust side. FIG. 13 shows valve characteristics provided by the inlet and exhaust variable valve devices. In FIG. 1, the letter Fr designates a forward direction of the V-type engine.

Referring to FIG. 1, reference numeral 1 designates an engine body of the V-type engine. The engine body 1 includes a V-shape cylinder block 5 and cylinder heads 6. Specifically, the cylinder block 5 includes a common crankcase portion 2 in a lower portion thereof, and the cylinder block 5 includes V-shape deck cylinder portions 4 in an upper portion thereof. Each of the V-shape deck cylinder portions 4 has three cylinders 3. The cylinder heads 6 are mounted on head portions of the deck cylinder portions 4 respectively.

Small components such as a head cover and an oil pan are not shown in FIG. 1. Each of right and left banks 7*b* and 7*a* projected in the V-shape is formed by the deck cylinder portion 4 and the cylinder head 6. The right and left of the banks are defined based on the forward direction. As shown in FIG. 2, a piston 8 is accommodated in the cylinder 3 in each of the banks 7*a* and 7*b* while being able to be reciprocated. A crankshaft (not shown) is incorporated into the crankcase portion 2. However, the banks 7*a* and 7*b* are offset in a back and forth direction such that connecting rods (not shown) extended from the pistons 8 are arranged parallel on an axial line of the crankshaft.

As shown in FIG. 2, a combustion chamber 11 is formed in a region facing the cylinder 3 in the lower surface of the cylinder head 6. In each combustion chamber 11, plural (for example, two) inlet ports 12*a* and 12*b* and plural (for example, two) inlet valves 13*a* and 13*b* are provided in the inside between the banks 7*a* and 7*b*. The inlet valves 13*a* and 13*b* open and close the inlet ports 12*a* and 12*b* respectively.

Plural (for example, two) exhaust ports 14*a* and 14*b* and plural (for example, two) exhaust valves 15*a* and 15*b* are provided in the outside between the banks 7*a* and 7*b*. The exhaust valves 15*a* and 15*b* open and close the exhaust ports 14*a* and 14*b*. Therefore, combustion air is drawn from the inside of the bank, and the burned gas is exhausted from the outside of the bank. A consistently-closed structure biased toward a closed direction by a valve spring (not shown) is used in the inlet valves 13*a* and 13*b* and the exhaust valves 15*a* and 15*b* respectively.

Single overhead camshaft (SOHC) variable valve systems 17 are provided in the cylinder heads 6 of the right and left banks 7*b* and 7*a*, and the variable lift operations of the inlet and exhaust valves can be realized in SOHC variable valve systems 17.

The variable valve system 17*a* of left bank 7*a* includes an (three-mode switchable) inlet variable valve device 18 and an (two-mode switchable) exhaust variable valve device 19 (corresponding to a variable valve device of the invention). A normal (low-speed) mode, a high-speed mode, and a cylinder-suspension mode (mode for suspending the cylinder) can be switched in the inlet variable valve device 18. The normal (low-speed) mode and the cylinder-suspension mode (mode for suspending the cylinder) can be switched in the exhaust variable valve device 19.

The variable valve system 17*b* of the right bank 7*b* includes an (two-mode switchable) inlet variable valve device 20 and an exhaust variable valve device 21. The normal (low-speed) mode and high-speed mode can be switched in the inlet variable valve device 20. The exhaust variable valve device 21 has only the normal (low-speed) mode.

FIG. 2 shows the whole of both the inlet and exhaust variable valve devices 18 and 19 of the one cylinder of the variable valve system 17*a* mounted on the left bank 7*a*. FIG. 2 shows the variable valve devices 18 and 19 when viewed from behind the engine. FIG. 9 shows the inlet variable valve device 18 when viewed from the inside. FIG. 10 shows a state in which the variable valve device 18 is taken apart. FIG. 11 shows the exhaust variable valve device 19 when viewed from the inside. FIG. 12 shows a state in which the variable valve device 19 is taken apart.

A structure of the one cylinder will be described below. Referring to FIGS. 2 and 3, a rotatable camshaft 25 is arranged along a longitudinal direction of the cylinder head 6 in the center of an overhead location of the combustion chamber 11. An inlet-side rocker shaft 26 is fixed to the inside of the bank while arranged substantially parallel to the camshaft 25. An exhaust-side rocker shaft 27 is fixed to the outside of the bank while arranged substantially parallel to the camshaft 25. Both the rocker shafts 26 and 27 are arranged above the camshaft 25.

An oil passage 27*a* for the cylinder-suspension mode is formed along an axial direction in the rocker shaft 27. An oil passage 26*a* for the cylinder-suspension mode and an oil passage 26*b* for high-speed mode are formed along the axial direction in the rocker shaft 26. The oil passage 26*a* and the oil passage 26*b* are communicated with an end of the oil passage 27*a*.

The camshaft 25 is rotated by a crank output. As shown in FIGS. 2 and 4, a high-speed inlet cam 30, a non-lift cam (suspending cam) 31, an exhaust cam 32 and a low-speed inlet cam 33 are formed in the order from the rear side in the region where the camshaft 25 is arranged in the overhead location of the combustion chamber 11.

The low-speed inlet cam 33 has a cam profile in which open-close timing and a valve lift amount are set so as to be suitable for low-speed running of the engine. The high-speed inlet cam 30 has a cam profile in which open-close timing and a valve lift amount (larger than that of the low-speed cam 33) are set so as to be suitable for high-speed running of the engine in the same base circle as the low-speed inlet cam 33. The non-lift cam 31 has a cam profile (only the base circle) having the same radius. The exhaust cam 32 has a cam profile in which open-close timing and a valve lift amount are set so as to be suitable to the discharge of the combustion gas.

As shown in FIGS. 2, 9, and 10, the inlet variable valve device 18 includes a divided-type rocker arm structure. In the rocker arm structure, a valve drive rocker 35 is separated from high-speed and low-speed cam follower rockers 60 and 70. The valve drive rocker 35 drives the inlet valves 13*a* and 13*b*. The cam follower rockers 60 and 70 drive the high-speed and low-speed inlet cams 30 and 33.

For details, as shown in FIGS. 2 and 10, the valve drive rocker 35 includes a cylindrical rocker shaft supporting boss 36, a pair of rocker arms 37, adjustment screws 38, and mode switching operation portion 40*a* and 40*b*. The rocker arms 37 are arranged in the axial direction while projected toward the radial direction from both end portions of the boss 36. The adjustment screws 38 are incorporated into end portions of the rocker arms 37. The switching operation portions 40*a* and 40*b* are provided in base portions of the rocker arms 37 respectively.

As shown in FIG. 2, the rocker shaft 26 is rotatably fitted and inserted into the rocker shaft supporting boss 36 over the portion including the point of the (high-speed) inlet cam 30 to the point of the (low-speed) inlet cam 33. The rocker shaft supporting boss 36 positions the adjustment screw 38 at the front end of each rocker arm 37 to an upper end (valve stem end) of each of the inlet valves 13*a* and 13*b*. That is, the inlet valves 13*a* and 13*b* are driven when the valve drive rocker 35 rocks the rocker shaft 26 about a fulcrum.

In an outer peripheral surface of the boss 36, as shown in FIGS. 3, 4, and 8 to 10, a slipper 41 is projected toward an outer peripheral surface of the non-lift cam 31 from the region where the boss 36 corresponds to the non-lift cam 31. A projected length of the slipper 41 is set to a size, in which the front-end portion of the slipper 41 can abut on the outer peripheral surface of the non-lift cam 31 when the inlet valves 13*a* and 13*b* are closed.

When the inlet valves 13*a* and 13*b* are closed, the slipper 41 is caused to abut on the non-lift cam 31 by reaction forces of the valve springs of the inlet valves 13*a* and 13*b*, which prevents accidental motion of the whole of the valve drive rocker 35.

Figure 5:
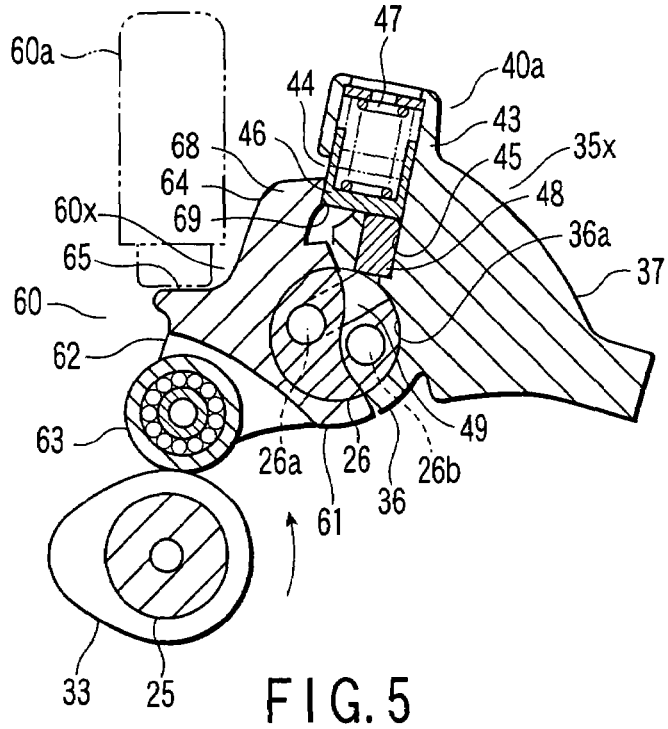
FIG. 5 is a sectional view showing the variable valve device on the inlet side (low speed) when viewed from an arrow B of FIG. 3.

A piston type switching operation portion is used as both the switching operation portions 40*a* and 40*b* arranged in both end portions of the boss 36. The switching operation portion 40*a* arranged on the side of the (low-speed) inlet cam 33 will be described below. Referring to FIGS. 5, 9, and 10, a cylinder 43 is formed in the based portion of the rocker arm 37 on the side of the inlet cam 33. The cylinder 43 is a longitudinal one which is extended along a radial direction of the rocker shaft 26. A window 44 is formed in a front surface (surface on the side of the camshaft 25) in the lower portion of the cylinder 43. A through hole 45 (shown only in FIG. 5) having a diameter smaller than that of the cylinder 43 is made from a bottom of the cylinder 43 to an inner surface 36*a* (bearing surface) of the boss 36 located immediately below the cylinder 43.

A piston 46 is accommodated in the cylinder 43 along with a compression spring 47 which biases the piston 46 against the bottom of the cylinder 43 (shown only in FIG. 5). Therefore, usually the window 44 of the cylinder 43 is closed by the lower outer peripheral surface of the piston 46, and the piston 46 is retracted from the window 44 to open the window 44 when the piston 46 is raised.

As shown in FIG. 5, a pin 48 is slidably accommodated in the through hole 45. As shown in FIG. 5, an opening located at a lower end of the through hole 45 communicates with a branch passage 49 branched from the oil passage 26*a*. Specifically, the branch passage 49 is radially branched from the oil passage 26*a* and the branch passage 49 is opened to the outer peripheral surface of the rocker shaft 26. When an oil pressure is applied to the pin 48 through the oil passage 26*a*, the piston 46 is driven toward the direction in which the piston 46 is retracted from the window 44 by the raised motion of the pin 48 as shown by an alternate long and two dashes line of FIG. 5. That is, the window 44 is opened.

Figure 6:
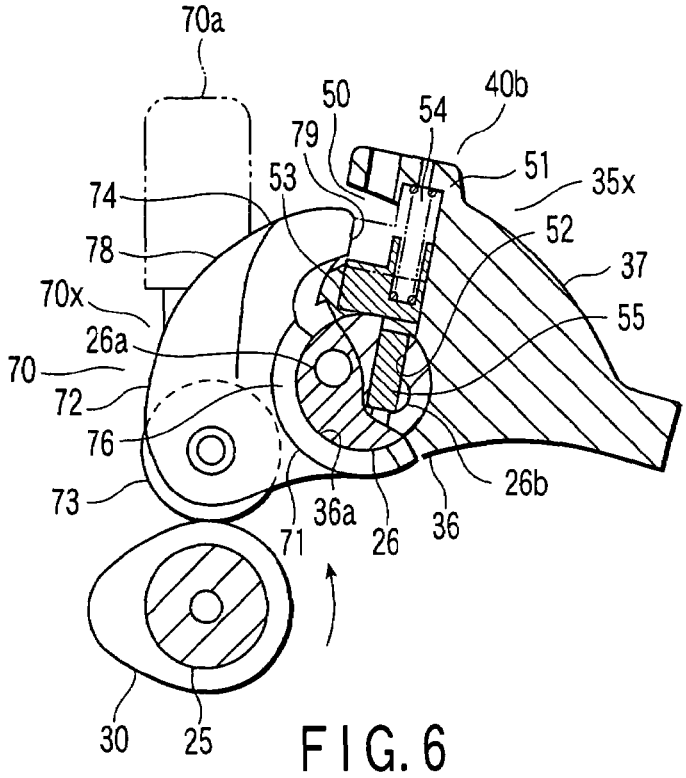
FIG. 6 is a sectional view showing the variable valve device on the inlet side (high speed) when viewed from an arrow C of FIG. 3.

As with the switching operation portion 40*a*, a structure in which a cylinder 51 is formed in the base portion of the rocker arm 37 is used in the switching operation portion 40*b* arranged on the side of the (high-speed) inlet cam 30 as shown in FIGS. 6, 9, and 10. A through hole 52 communicated with the cylinder 51 in series is made in the rocker shaft 26 located immediately below the cylinder 51. The through hole 52 has the diameter smaller than that of the cylinder 51.

Unlike the switching operation portion 40*a*, as shown in FIG. 6, a window 50 is formed in the upper front surface of the cylinder 51, and a piston 53 is accommodated in the cylinder 51 along with a compression spring 54 which biases the piston 53 downward.

A low-profile piston is used as the piston 53 such that the piston 53 can be accommodated in the cylinder portion on the lower side from the window 50. Contrary to the switching operation portion 40*a*, usually the opening of the window 50 of the cylinder 51 is opened, and the opening is closed by the outer peripheral surface of the piston 53 when the piston 53 is raised.

A pin 55 is slidably accommodated in the through hole 52. As shown in FIG. 6, the lower-end portion of the through hole 52 communicates with a part of the oil passage 26*b* while intersecting the oil passage 26*b*. When the oil pressure is applied to the pin 55 through the oil passage 26*b*, the piston 53 is driven toward the direction in which the piston 53 blocks the window 50 by the raised motion of the pin 55 as shown by the alternate long and two dashes line of FIG. 6. That is, the window 50 is closed.

As shown in FIG. 10, a pair of cut portions 57 is formed in opening edges on both end sides of the boss 36. The region ranging from the lower portion of each of the cylinders 43 and 51 to the base portion of the rocker arm 37 through the front portion of the boss 36 (the side on which the rocker arm 37 does not exist) is cut out in the cut portion 57.

As shown in FIGS. 2, 3, 6, 9, and 10, a high-speed-side cam follower rocker 70 is arranged adjacent to the end portion on the side of the (high-speed) inlet cam 30 of the boss 36 (valve drive rocker).

The cam follower rocker 70 includes a cylindrical rocker shaft supporting boss 71, a pair of roller support pieces 72, a roller 73, and a wing portion 74. The rocker shaft 26 located adjacent to the end of the boss 36 is rotatably fitted in the rocker shaft supporting boss 71. The roller support pieces 72 are linearly projected toward the overhead location of the (high-speed) inlet cam 30 from both end portions of the boss 71. The roller 73 is rotatably supported between the front-end portions of the roller support pieces 72. The wing portion 74 is formed in the boss 71.

The roller 73 is rotated while being in contact with the inlet cam 30. When the camshaft 25 is rotated, the cam follower rocker 70 is rotated about the boss 71, namely, the cam follower rocker 70 is rocked while following displacement of the inlet cam 30.

In order to maintain the following capability of the cam follower rocker 70, the roller 73 is pressed against the inlet cam 30 by the biasing force of a pusher 70*a* (partially shown by the alternate long and two dashes line in FIG. 6) input from a seat 75 formed in the roller support piece 71.

As shown in FIGS. 6 and 10, a cut portion 76 (only partially shown) is formed in the end portion of the boss 71 adjacent to the boss 36 (valve drive rocker), and an edge portion 36*b* remaining at the opening end of the boss 36 is accommodated in the cut portion 76. The whole of the cam follower rocker 70 is arranged at a position where the cam follower rocker 70 is shifted by the cut portion toward the side of the valve drive rocker 35 by utilizing the fitting of the components.

Specifically, the inside roller support piece 72 is arranged at the point where the roller support piece 72 is continued to the window 50 on the straight line by utilizing the shift. Therefore, the cam follower rocker 70 can be rocked while maintaining an attitude in which the inside roller support piece 72 is arranged in front of the window 50. Obviously the cut portion 57 and the cut portion 76 are formed in the sizes and shapes so as not to obstruct the motion of the cam follower rocker 70.

The wing portion 74 is formed by utilizing the roller support piece 72 arranged in front of the window 50 (shown in FIGS. 6 and 10). Specifically, in the upper portion of the roller support piece 72, a rib 78 is formed along the roller support piece 72. The rib 78 having an L-shape in cross section is gradually separated from the boss 71 toward the base portion of the roller support piece 72, and the rib 78 is gradually widened into an arc shape.

The wing portion 74 is formed by hanging over the front-end portion of the rib portion 78 to the point of the window 50. An abutment 79 which can enter into and leave from the window 50 is formed in a horizontal wall constituting the hung-over front-end portion. Usually the abutment 79 enters into and leaves from the cylinder 51 through the window 50. When the window 50 is blocked by the piston 53, the abutment 79 abuts on the piston 53 exposed from the window 50.

That is, the switching whether or not the displacement of the high-speed inlet cam 30 from the cam follower rocker 70 is input to the valve drive rocker 35 is carried out based on whether the abutment 79 constituting the front-end portion of the wing portion 74 strikes the air or abuts on the piston 53. That is, the switching operation portion 40*b* and the wing portion 74 constitute a switching mechanism for carrying out the above switching.

As shown in FIGS. 2, 3, 9, and 10, the lower-speed-side cam follower rocker 60 is arranged adjacent to the end portion on the side of the (low-speed) inlet cam 33 of the boss 36. The cam follower rocker 60 has a symmetric structure with the high-speed-side cam follower rocker 70. Because the cam follower rocker 60 has the same structure as the cam follower rocker 70, the same portions of the cam follower rocker 60 are designated by reference numerals 61 to 69 in place of the numerals 71 to 79 designating the portions of the cam follower rocker 70, and the description is omitted.

As shown in FIG. 5, usually the abutment 69 abuts on the piston 46 blocking the window 44 by the cam follower rocker 60. When the window 44 is opened, the abutment 69 enters and leaves from the cylinder 43 through the window 44.

The switching whether or not the displacement of the low-speed inlet cam 33 from the cam follower rocker 60 is input to the valve drive rocker 35 is carried out based on whether the abutment 69 strikes the air or abuts on the piston 46. The switching operation portion 40*a* and the wing portion 74 constitute the switching mechanism.

As shown in FIGS. 2, 7, 11, and 12, the exhaust variable valve device 19 includes the following structure (divided-type rocker arm structure). In the divided-type rocker arm structure, a cam follower rocker 80 is separated from a valve drive rocker 90. The cam follower rocker 80 follows the exhaust cam 32, and the valve drive rocker 90 drives the exhaust valves 15*a* and 15*b*.

The cam follower rocker 80 includes a cylindrical rocker shaft supporting boss 81, a U-shape roller support piece 82, a roller 83, and a wing portion 84. The portion corresponding to the exhaust cam 32 in the rocker shaft 27 is rotatably fitted in the rocker shaft supporting boss 81. The roller support piece 82 is linearly projected from both end portions of the boss 81 toward the overhead location of the exhaust cam 32. The roller 83 is rotatably supported between the front-end portions of the roller support piece 82. The wing portion 84 is formed in the boss 81.

The roller 83 is rotated while being in contact with the exhaust cam 32. When the camshaft 25 is rotated, the cam follower rocker 80 is rotated about the boss 81, namely, the cam follower rocker 80 is rocked while following the displacement of the exhaust cam 25. In order to maintain the following capability of the cam follower rocker 80, the roller 83 is pressed against the exhaust cam 32 by the biasing force of a pusher 80*a* (partially shown by the alternate long and two dashes line in FIG. 7) input from a seat 85 formed in the roller support piece 82.

The wing portion 84 has a rib 86 which is integrally formed in the center of the width direction in the outer surface of the boss 81. The rib 86 is extended along a circumferential direction of the boss 81 from the rear end portion of the roller support piece 82 to the upper portion of the boss 81. An abutment 89 is provided in the front-end portion of the rib 86, and the abutment 89 is formed by the horizontal wall hung over toward the forward direction.

As shown in FIGS. 11 and 12, a gate-type structure is adopted in the valve drive rocker 90. A pair of rocker arms 91 and a mode switching operation portion 98 (engages the wing portion 84 and corresponds to the switching portion of the invention) are combined in the gate-type structure of the valve drive rocker 90. The rocker arms 91 are arranged on both sides of the boss 81 (cam follower rocker 80).

A pair of cylindrical rocker shaft supporting bosses 92 are provided in one end portion of the rocker arms 91. The rocker shaft 27 on both sides where the boss 81 (cam follower rocker 80) is located therebetween in the rocker shaft 27 are rotatably fitted in The rocker shaft supporting bosses 92.

Arms 93 are provided in the other end portion of the rocker arms 91, and the arms 93 are linearly extended from the bosses 92 to the exhaust valves 15*a* and 15*b* respectively. One arm 93 is next to the another arm 93. Adjustment screws 94 are provided on the front-end portions of the respective arms 93. The adjustment screws 94 are arranged at upper ends (valve stem ends) of the exhaust valves 15*a* and 15*b* respectively.

The arms 93 are connected by a plate-shape connecting arm 95 (corresponding to the connecting arm of the invention) at the end portions of the arms 93, specifically, at the points where the adjustment screws 94 exist. Therefore, the pair of rocker arms 91 are integral with each other. That is, when the valve drive rocker 90 is rocked about the rocker shaft 27, the valve drive rocker 90 drives the exhaust valves 15*a* and 15*b*.

Figure 8:
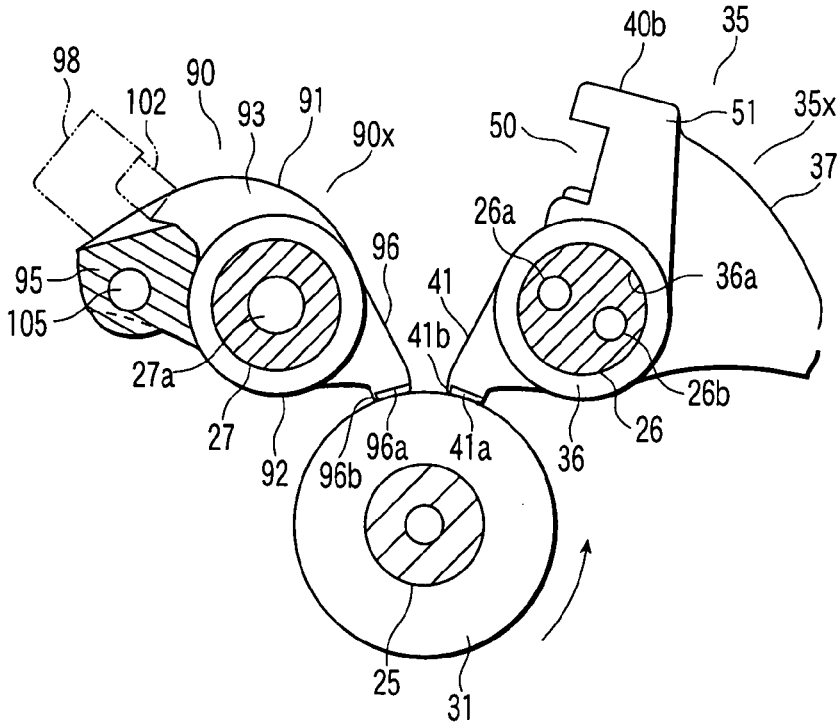
FIG. 8 is a sectional view showing a non-lift cam and a periphery thereof when viewed from an arrow E of FIG. 3.

In an outer peripheral surface of the boss 96, as shown in FIGS. 4, 8, and 12, a slipper 96 is projected toward the outer peripheral surface of the non-lift cam 31 from the region arranged in the overhead location of the non-lift cam 31. The projected length of the slipper 96 is set to a size, in which the front-end portion of the slipper 96 can abut on the outer peripheral surface of the non-lift cam 31 when the exhaust valves 15*a* and 15*b* are closed.

When the exhaust valves 15*a* and 15*b* are closed, the slipper 96 is caused to abut on the non-lift cam 31 by the reaction forces of the valve springs of the exhaust valves 15*a* and 15*b*, which prevents the accidental motion of the whole of the rocker arm 91.

Figure 7:
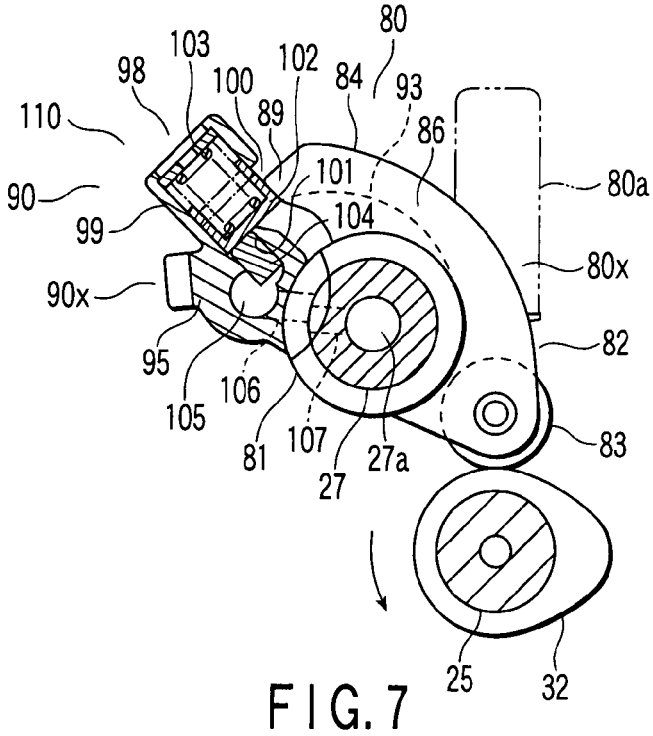
FIG. 7 is a sectional view showing the variable valve device on the exhaust side when viewed from an arrow D of FIG. 3.

As shown in FIGS. 11 and 12, the switching operation portion 98 is provided in the connecting arm 95, specifically, in the arm corresponding to the substantially central position between the exhaust valves 15*a* and 15*b*. A piston type switching operation portion is used as the switching operation portion 98. FIG. 7 shows the detailed structure of the switching operation portion 98.

The switching operation portion 98 will be described below. Referring to FIG. 7, a vertical cylinder 99 is formed so as to be projected upward from the center (point which becomes the substantial center between the exhaust valves 15*a* and 15*b*) of the connecting arm 95. The cylinder 99 is inclined toward the direction in which the cylinder 99 is separated from the rocker shaft 27. A window 100 is formed in the front surface (surface on the side of the camshaft 25) in the lower portion of the cylinder 99. A through hole 101 having a diameter smaller than that of the cylinder 99 is made from the bottom of the cylinder 99 to the inside of the arm located immediately below the cylinder 99.

A piston 102 is accommodated in the cylinder 99 along with a compression spring 103 which biases the piston 102 against the bottom of the cylinder 99. Therefore, usually the window 100 of the cylinder 99 is closed by the outer peripheral surface of the piston 102. The piston 102 is retracted from the window 100 to open the window 100 when the piston 102 is raised.

As shown in FIGS. 3 and 7, a pin 104 is slidably accommodated in the through hole 101. An opening located at a lower end of the through hole 101 communicates with a relay passage 105 and a relay passage 106. The relay passage 105 is formed inside the connecting arm 95. The relay passage 106 is formed in the arm 93 to communicate the relay passage 105 with the inside of the boss 92.

The relay passage 106 communicates with a branch passage 107 (only shown in FIG. 7) branched from the oil passage 27*a*. Specifically, the branch passage 107 is radially branched from the oil passage 27*a* and is opened to the outer peripheral surface of the rocker shaft 26. When the oil pressure is applied to the pin 104 through the oil passage 27*a*, the piston 102 blocking the window 100 is driven toward the direction in which the piston 102 is retracted from the window 100 by the raised motion of the pin 104 as shown by an alternate long and two dashes line of FIG. 7. That is, the window 100 is opened.

The abutment 89 of the cam follower rocker 80 is positioned in front of the window 100. As shown in FIG. 7, the abutment 89 is formed in the shape in which the abutment 89 can enter into and leave from the window 100. Therefore, usually the abutment 89 abuts on the piston 102 blocking the window 100. When the window 100 is opened, the abutment 89 enters into and leaves from the cylinder 99 through the window 100.

That is, the switching whether or not the displacement of the exhaust cam 32 from the cam follower rocker 80 is input to the valve drive rocker 90 is carried out based on whether the abutment 89 strikes the air or abuts on the piston 102. That is, the switching operation portion 98 and the wing portion 84 constitute a switching mechanism 110 (corresponds to the switching portion of the invention).

On the other hand, as shown in FIG. 2, the oil passage 27*a* of the exhaust-side rocker shaft 27 is connected to an oil-pressure supply unit (formed by an oil pump: not shown) through an oil control valve 120 (hereinafter referred to as an OCV 120) for the cylinder-suspension mode. The oil passage 26*b* of the inlet-side rocker shaft 26 is connected to the oil-pressure supply unit (formed by an oil pump) through an oil control valve 121 (hereinafter referred to as an OCV 121) for the high-speed mode.

The OCVs 120 and 121 which are the two oil-pressure supply systems are connected to a control unit 122 (for example, the control unit includes a microcomputer). The control unit 122 has functions of closing the OCVs 120 and 121 in the low-speed mode, opening the OCV 121 in the high-speed mode, and opening the OCV 120 in the cylinder-suspension mode according to a map which is previously set depending on the running state of the automobile.

Such a structure is adopted as each cylinder of the left bank 7*a*, which enables three-stage switching of the valve drive with the high-speed inlet cam 30, the valve drive with the low-speed inlet cam 33, and the non-valve drive in the inlet system of the left bank 7*a*. In the exhaust system of the left bank 7*a*, the two-stage switching of the valve drive and the non-valve drive is carried out by the exhaust cam 32.

On the other hand, the structure, in which the mechanisms and components associated with the non-valve drive are removed from the inlet variable valve device 18 of the left bank 7*a*, is used as each inlet variable valve device 20 of the variable valve system 17*b* of the right bank 7*b*. Although not shown, in the structure, the low-speed-side switching structure (mainly switching operation portion 40*a* and cam follower rocker 60) is omitted, and the low-speed inlet cam 33 always directly drives the valve drive rocker 35. Therefore, the two-stage switching can be carried out between the low-speed mode and the high-speed mode while only the high-speed-side switching structure is left.

The structure in which the mechanisms and components associated with the non-valve drive are removed from the exhaust variable valve device 19 of the left bank 7*a*, i.e., the structure in which the exhaust cam 32 always directly drives only the valve drive rocker 90 is used on the exhaust side.

In the structure of the right bank 7*b*, the oil passages 26*a* and 27*a* for the cylinder-suspension mode are omitted, and only the oil passage 26*b* is left. That is, in the inlet system, the right bank 7*b* has the structure in which the two-stage switching is carried out between the valve drive with the high-speed inlet cam 30 and the valve drive with the low-speed inlet cam 33. In the exhaust system, the right bank 7*b* has the structure in which only the valve drive is carried out by the exhaust cam 32.

The running state in which parts of the cylinders (three cylinders of the left bank 7*a*) are suspended is carried out by the variable valve systems 17*a* and 17*b* of the right and left banks 7*b* and 7*a*.

In the variable valve devices 18, 19, and 20, bodies 60*x*, 70*x*, and 80*x* (the whole rocker) of the cam follower rockers 60, 70, and 80 have a portion to which a high impact load is imposed. Examples of the portion include a region which receives the displacements of the cams 30, 32, and 33 and the abutments 69, 79, and 89 which abut on the pistons 46, 53, and 102.

Therefore, the portions to which the high impact load is imposed is made of steel to which quenching is carried out to secure strength. That is, the bodies 60*x*, 70*x*, and 80*x* are formed by the following forming process. The bodies 60*x*, 70*x*, and 80*x* are formed by casting with the iron-based metal material, specifically, the steel. The strength is secured by carrying out the quenching on the casting product, and dimensional accuracy is secured by carrying out polishing on the casting product.

The valve drive rockers 35 and 90 comprise the cylinder 43, 51, and 99. The cylinder 43, 51, and 99 accommodating the piston 46, 53, and 102 are required high accuracy. High strength is not required in the cylinder 43, 51, and 99 unlike the cam follower rockers 60, 70, and 80.

The valve drive rockers 35 and 90 in which the dimensional accuracy has higher priority than the strength are made of not the iron-based metal material such as the steel for which the heat treatment is required, but a different material for which the heat treatment is not required, i.e., a non iron-based metal material.

Specifically, in the valve drive rockers 35 and 90, an aluminum material is used as the forming material. The bodies 35*x* and 90*x* (the whole except for the piston) of the valve drive rockers 35 and 90 are made of the aluminum material.

As shown in FIGS. 8 to 12, in the aluminum valve drive rockers 35 and 90, the sliders 41*a* and 96*a* are provided in the front-end portions of the slippers 41 and 96 to cover wear resistance of the slippers 41 and 96 respectively. The sliders 41*a* and 96*a* are separately formed by a member having the excellent wear resistance as a component which slides and comes into contact with the non-lift cam 31.

Thus, the aluminum valve drive rockers 35 and 90 are configured. As shown in FIG. 8, in the front end portions of the slippers 41 and 96, stoppers 41*b* and 96*b* are formed on the rear sides in the rotating direction of the non-lift cam 31 of the sliders 41*a* and 96*a* such that the sliders 41*a* and 96*a* do not drop out due to the rotation of the non-lift cam 31. The stoppers 41*b* and 96*b* are formed by projections respectively.

Action of the variable valve system 17 will be described with reference to FIGS. 5 to 8. It is assumed that a command for enabling the low-speed mode is sent to the control unit 122 according to the running state of the automobile. Then, the OCVs 120 and 121 are closed by the control unit 122. That is, the oil-pressure system does not act on the oil passages 26*a*, 26*b*, and 27*a* with the oil pressure.

Therefore, as shown by a solid line of FIG. 5, the window 44 of the switching operation portion 40*a* (inlet) of the left bank 7*a* is blocked by the piston 46 (by the elastic force of the compression spring 47). The window 50 of the switching operation portion 40*b* (inlet) is opened (by the elastic force of the compression spring 54) as shown by a solid line of FIG. 6. As shown in FIG. 7, the window 100 of the switching operation portion 98 (exhaust) of the left bank 7*a* is blocked by the piston 102 (by the elastic force of the compression spring 103).

Then, on the inlet side of the left bank 7*a*, the (high-speed) cam follower rocker 70 is rocked while striking the air. At the same time, the (low-speed) cam follower rocker 60 is rocked while abutting on the piston 46. In the exhaust side of the left bank 7*a*, the cam follower rocker 80 is rocked while abutting on the piston 102.

Therefore, on the inlet side, the displacement of the (low-speed) inlet cam 33 transmitted from the cam follower rocker 60 is transmitted from the valve drive rocker 35 to the pair of inlet valves 13*a* and 13*b* through the pair of rocker arms 37, which drive the inlet valves 13*a* and 13*b*.

On the exhaust side, the displacement of the exhaust cam 32 transmitted from the cam follower rocker 80 is transmitted from the connecting arm 95 of the valve drive rocker 90 to the pair of exhaust valves 15*a* and 15*b* through the pair of arms 93 extended toward the valve end, which drives the exhaust valves 15*a* and 15*b*.

In the variable valve device 20 of the right bank 7*b*, as with the left bank 7*a*, the (high-speed) cam follower rocker strikes the air. Therefore, only the displacement of the low-speed inlet cam transmitted to the valve drive rocker is transmitted to the pair of inlet valves, which drive the inlet valves. In the variable valve device 21 on the exhaust side, the displacement of the exhaust cam is directly transmitted to the pair of exhaust valves through the pair of arms, which drive the exhaust valves by the valve drive rocker.

Therefore, the V-type engine is operated in the low-speed mode brought by the combination of the low-speed cam and the exhaust cam of FIG. 13. That is, the V-type engine outputs the engine performance required in the normal running.

When a command for enabling the high-speed mode is sent to the control unit 122 according to the running state of the automobile, only the OCV 121 for the high-speed mode is opened by the control unit 122. That is, the oil pressure is applied only to the oil passage 26*b*.

Then, the oil pressure is applied to the pin 55 of the (inlet-side) switching operation portion 40*b* of the left bank 7*a*. Therefore, the piston 53 is driven upward by the pin 55, which blocks the window 50 as shown by the alternate long and two dashes line of FIG. 6. On the exhaust side of the left bank 7*a*, the window 100 of the switching operation portion 98 is blocked by the piston 102.

Then, as shown by the alternate long and two dashes line of FIG. 6, the inlet-side cam follower rocker 70 is rocked while abutting on the piston 53.

At this point, the window 44 of the switching operation portion 40*a* is blocked by the piston 46. However, because the outer shape of the high-speed inlet cam 30 is set larger than that of the low-speed inlet cam 33, only the displacement of the (high-speed) inlet cam 30 transmitted from the cam follower rocker 70 is transmitted from the valve drive rocker 35 to the pair of inlet valves 13*a* and 13*b* through the pair of rocker arms 37.

That is, the inlet valves 13*a* and 13*b* are driven by the high-speed inlet cam 30. The displacement of the exhaust cam 32 is transmitted from the cam follower rocker 80 to the connecting arm 95 of the valve drive rocker 90, which continuously drives the exhaust valves 15*a* and 15*b*.

In the variable valve device 20 of the right bank 7*b*, as with the left bank 7*a*, the displacement of the (high-speed) inlet cam transmitted from the cam follower rocker is transmitted from the valve drive rocker to the pair of inlet valves through the pair of rocker arms, which drive the inlet valves. The variable valve device 21 of the right bank 7*b* directly and continuously drives the pair of exhaust valves by the valve drive rocker.

Therefore, the V-type engine is operated in the high-speed mode brought by the combination of the high-speed cam and the exhaust cam of FIG. 13. That is, the V-type engine is switched to the output of the high engine performance.

When a command for enabling the cylinder-suspension mode is sent to the control unit 122 according to the running state of the automobile, only the OCV 120 for the cylinder-suspension mode is opened by the control unit 122, which applies the oil pressure to the oil passages 26*a* and 27*a*.

Therefore, on the inlet side of the left bank 7*a*, the oil pressure is applied to the pin 48 to drive the pin 48 upward, which upwardly drives the piston 46 of the switching operation portion 40*a* to open the window 44 as shown by the alternate long and two dashes line of FIG. 5.

Because the oil pressure is not applied to the switching operation portion 40*b*, the window 50 remains opened as shown in FIG. 6. On the exhaust side, the piston 102 of the switching operation portion 98 is also driven upward by raising the piston 104, which opens the window 100 of the switching operation portion 98.

Therefore, in the left bank 7*a*, the cam follower rocker 60 (inlet: low speed), the cam follower rocker 70 (inlet: high speed), and the cam follower rocker 80 (exhaust) are rocked while striking the air, which blocks the transmission of the driving force for driving the valve to the valve drive rockers 35 and 90 (inlet and exhaust).

Accordingly, as shown in FIG. 8, because the slippers 41 and 96 of the valve drive rockers 35 and 90 slide continuously on the circular cam surface (outer peripheral surface) of the non-lift cam 31, the inlet valves 13*a* and 13*b* and the exhaust valves 15*a* and 15*b* are maintained in the closed state. The cam follower rockers 60, 70, and 80 are continuously pressed against the cam surface by the pushers 60*a*, 70*a*, and 80*a*.

In the left bank 7*a*, the separation between the cam follower rockers 60, 70, and 80 and the valve drive rockers 35 and 90 stops the lifts (open and close) of the inlet valves 13*a* and 13*b* and the exhaust valves 15*a* and 15*b*.

At this point, as with the low-speed mode, in each of the inlet variable valve device 20 and the exhaust variable valve device 21 of the right bank 7*b*, the displacement of the low-speed inlet cam is continuously transmitted to the inlet valve while the displacement of the exhaust cam is continuously transmitted to the exhaust valve, which switches to the cylinder-suspension mode in which parts of the cylinders (cylinders of left bank 7*a*) are suspended.

Thus, in the engine in which the gate-type valve drive rocker 90 is adopted on the exhaust side, even if the valve drive rocker 90 is arranged while offset toward one side (one side of the cylinder 3) between the exhaust valves 15*a* and 15*b* as shown in FIG. 3, the pair of arms 93 which drive the valve are arranged parallel in the linear passage from the point where the exhaust valves 15*a* and 15*b* are located to the point of the rocker shaft 27 on both the sides of the cam follower rocker 80 by changing (adjusting) the width of the boss 92 or the position of the arm 93.

Additionally, the load is imposed on the pair of arms 93 with no swing stress, when the valve drive rocker 90 is pushed down to open the exhaust valves 15*a* and 15*b* or when the valve drive rocker 90 is returned to close the exhaust valves 15*a* and 15*b* by the connection of the end portions of the arms 93 with the connecting arm 95.

Accordingly, the structure of the gate-type valve drive rocker 90 can always repeat a predetermined valve lift to improve the engine performance. Furthermore, when the switching operation portion 98 which switches the transmission between the cam follower rocker 80 and the valve drive rocker 90 is provided in the connecting arm 95, because the load from the cam follower rocker 80 is symmetrically imposed onto the exhaust valves 15*a* and 15*b*, namely, because the load is equally imposed on the exhaust valves 15*a* and 15*b*, the high reproducibility is obtained in the valve lifts.

Particularly, when the switching operation portion 98 is provided in the substantial center between the exhaust valves 15*a* and 15*b*, the even load is imposed on the exhaust valves 15*a* and 15*b*, so that the higher reproducibility is obtained.

Because the heavy switching operation portion 98 including the cylinder and the piston is provided in the connecting arm 95, the load generated by the increased weight of the switching operation portion 98 is also evenly imposed, so that the reproducibility is increased in the valve lifts.

Additionally, because a part of the switching portion is provided in the connecting portion to suppress the increase in weight, not only the friction is reduced, but also particularly the design valve lift is easily reproduced at high engine speed, which obtains high engine performance. Because the load bias is hardly generated for the switching abutment, the movement of the contact point is suppressed in the switching abutment. Therefore, the wear is suppressed in the switching region to improve the durability.

According to the variable valve devices 18, 19, and 20 which carry out the mode switching, the required strength is secured by the quenching (heat treatment) for the cam follower rockers 60, 70, and 80 (made of iron-base metal).

The valve drive rockers 35 and 90 which link with the cam follower rockers 60, 70, and 80 are made of non iron-based metal material for which the heat treatment is not required. Therefore, the valve rocker 35 and 90 are able to secure the dimensional accuracy. The same holds true for the right bank 7*b*.

In the valve drive rockers 35 and 90 in which the dimensional accuracy has the higher priority, unlike the cam follower rockers 60, 70, and 80, the adoption of the non iron-based metal material eliminates not only the quenching (heat treatment) but also polishing which is carried out on a region where hardness is increased by the heat treatment. That is, a near net shape is achieved in the valve drive rockers 35 and 90, thereby decreasing the machining man-hours required until the component is completed.

Accordingly, in the variable valve devices 18, 19, and 20, the production cost can be suppressed by forming the valve drive rockers 35 and 90 with the material different from the cam follower rockers 60, 70, and 80, i.e., with the non iron-based metal material. Because the valve drive rockers 35 and 90 having the pistons 46, 53, and 102 are made of the aluminum material in the non iron-based metal material, the region for which the machining is required, i.e., each portion of the cylinders 43, 51, and 99 accommodating the pistons 46, 53, and 102 is formed not only by the polishing but by other machining methods. Therefore, machinability is improved to rationally carry out the machining.

There is no risk of the heat deformation caused by the quenching in the valve drive rockers 35 and 90, so that the product is easily obtained with high accuracy. Therefore, cost reduction is further achieved in the variable valve devices 18, 19, and 20.

Even if the valve drive rockers 35 and 90 are made of the non iron-based metal material, e.g., the aluminum material for which the heat treatment is not required, the valve drive rockers 35 and 90 have the sufficient durability because the strength against the swing is enhanced in the valve drive rockers 35 and 90. As a result, the machining man-hours are reduced for the valve drive rocker 90.

The load imposed on each piston becomes substantially equal by the symmetric arrangement of the cam follower rockers. Therefore, because the wear of the cylinder is suppressed, the valve drive rockers 35 and 90 have the sufficient durability, even if the valve drive rockers 35 and 90 are made of the non iron-based metal material, e.g., the aluminum material for which the heat treatment is not required. In the case where the cam follower rockers are not symmetrically arranged, the large load is imposed on one of the cylinders, which causes the cylinder to be easily worn.

Figure 14:
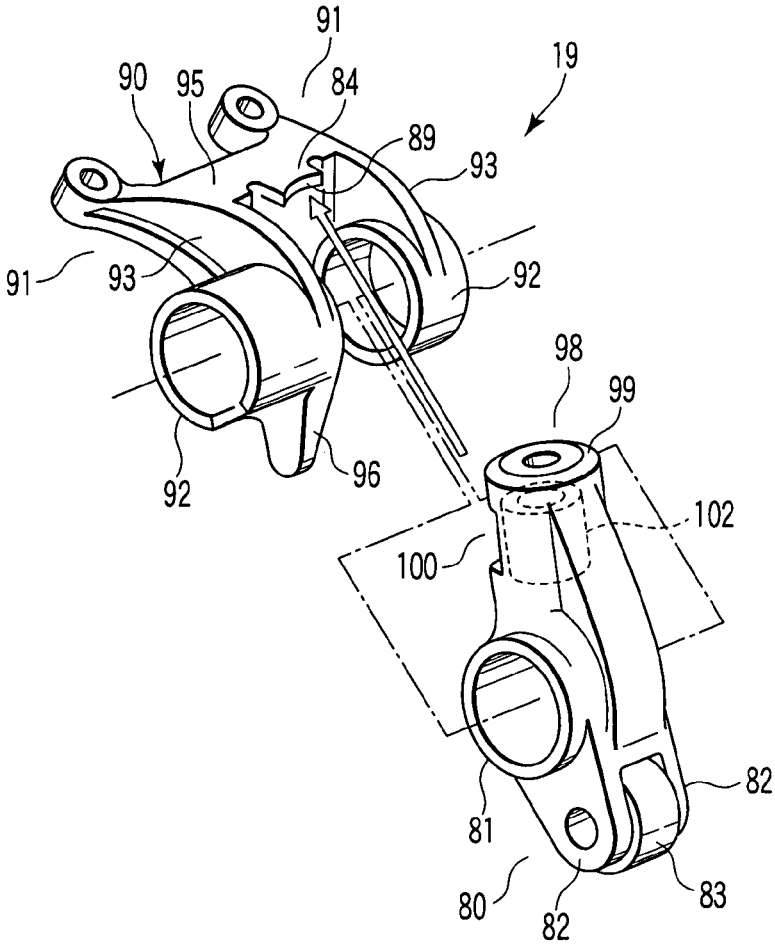
FIG. 14 is an exploded perspective view showing a main part of a variable valve device according to a second embodiment of the invention.

FIG. 14 shows a variable valve device according to a second embodiment of the invention. In the first embodiment, the switching operation portion 98 is provided in the connecting arm 95 of the valve drive rocker 9, the wing portion 84 is provided in the cam follower rocker 80, and the transmission is switched between the cam follower rocker 80 and the valve drive rocker 90.

Alternatively, as shown in FIG. 14, the wing portion 84 (corresponds to the switching portion of the invention) is provided in the connecting arm 95 of the valve drive rocker 90, the switching operation portion 98 is provided in the cam follower rocker 80, and thereby the transmission may be switched between the cam follower rocker 80 and the valve drive rocker 90.

However, in the second embodiment, the composition having the similar function as the first embodiment is designated by the same reference numeral and the description thereof is omitted.

In the second embodiment, the same effects as the first embodiment are obtained.

Figure 15:
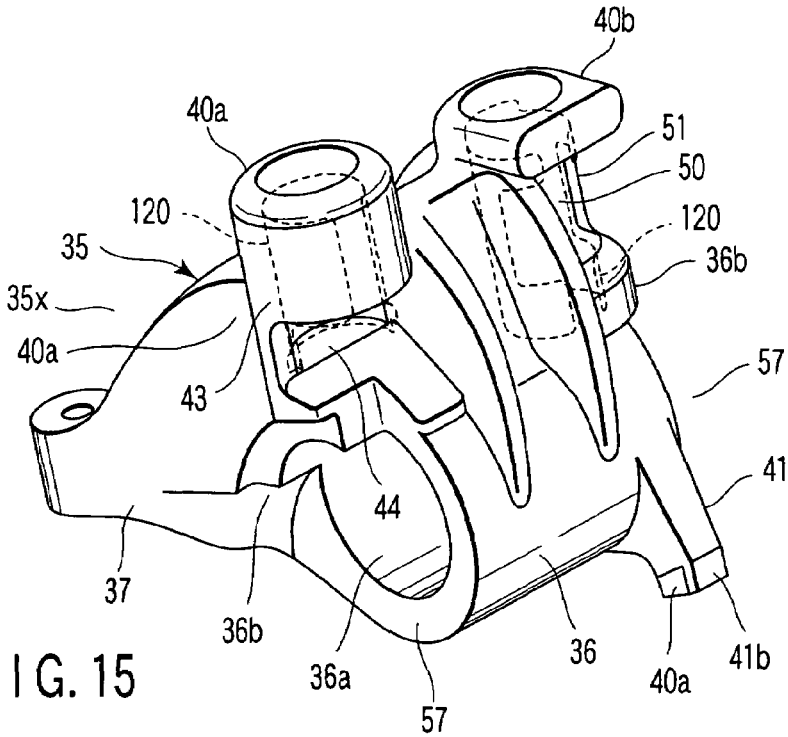
FIG. 15 is an exploded perspective view showing a main part of a variable valve device according to a third embodiment of the invention.
Figure 16:
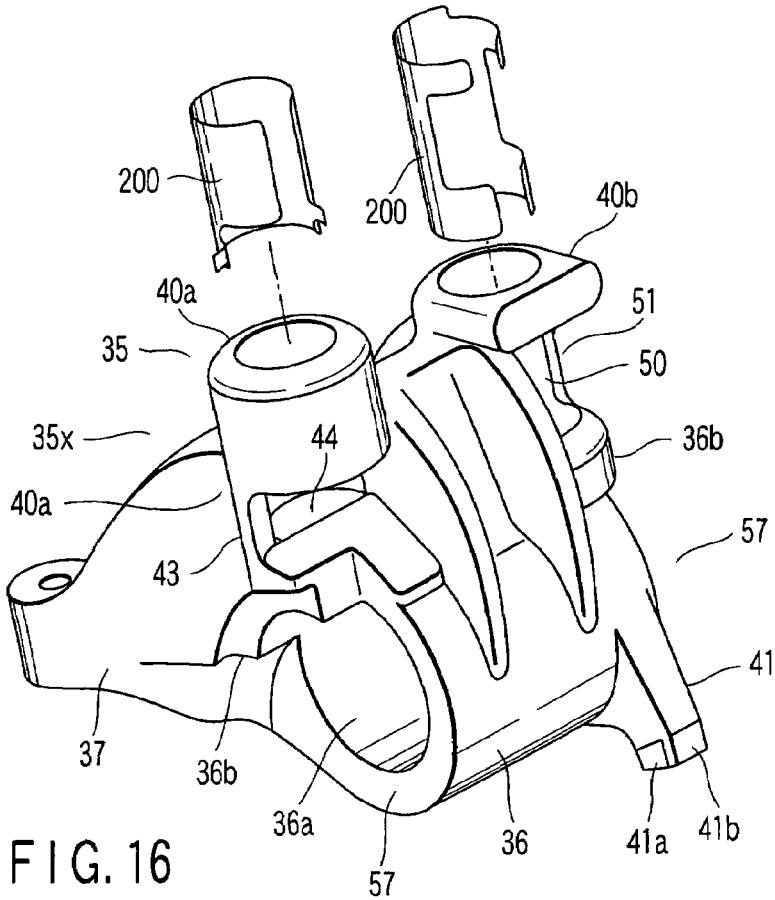
FIG. 16 is perspective view showing a state in which a sleeve is taken apart from each cylinder of the valve drive rocker shown in FIG. 15.

FIGS. 15 and 16 show a variable valve device according to a third embodiment of the invention. In the third embodiment, in each portion of the valve drive rocker made of the aluminum material, a substantially cylindrical (C-shape) sleeve formed by a thin sheet metal is fitted in the inner surface of the cylinder.

FIGS. 15 and 16 show the typical structure. Cylindrical sleeves 200 shown in FIG. 16 are fixed to the inner surfaces of the cylinders 43 and 51 of the valve drive rocker 35. In the sleeves 200, portions corresponding to the windows 44 and 50 are opened. The sleeve 200 is fixed by the elastic force in the direction in which the sleeve 200 is extended. The sleeve 200 may be of course incorporated into the cylinder of another valve drive rocker. The sleeve 200 is made of the iron-based metal material, e.g., the steel.

Thus, when the sleeve 200 is provided, the sliding loads of the pistons 46 and 53 are mainly imposed on the sleeve 200, so that in addition to the effects obtained in the first embodiment the wear resistance is enhanced in the cylinders 43 and 51.

However, in FIGS. 15 and 16, the composition having the similar function as the first embodiment is designated by the same reference numeral and the description thereof is omitted.

The sleeve 200 may be adopted in the variable valve device described in the second embodiment.

The invention is not limited to the above embodiments, but various changes and modifications could be made without departing from the scope of the invention. For example, the invention is applied to the V-type engine in the above embodiments. Alternatively, the invention may be applied to other engines, such as a straight-type engine, in which the cylinders are arranged in a different way.

Although the non-lift cam and the exhaust cam are switched in the embodiments, the invention may be applied to the switching between a small lift and a large lift including the small lift. In this case, although the load becomes imbalance during the low lift, there is generated no problem because the load is small during the low lift. The effect of the invention is similarly obtained during the high lift with the high load.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A variable valve device for an internal combustion engine, the device comprising:

a camshaft which is rotatably provided in an internal combustion engine while having a cam;

a rocker shaft which is arranged next to the camshaft;

a valve is driven by the cam;

a cam follower rocker which is rotatably provided in the rocker shaft, and is rocked by following the cam;

a valve drive rocker which is rotatably provided in the rocker shaft next to the cam follower rocker, and drives the valve, either a body of the cam follower rocker or a body of the valve drive rocker is made of an iron-based metal material, and the other body is made of a material different from the iron-based metal material, heat treatment being not required in the different material; and a switching portion which makes the valve drive rocker in a drive state by rendering the cam follower rocker abut on the valve drive rocker, makes the valve drive rocker in a non-drive state by canceling the abutment, and is able to switch the valve drive rocker between the drive state and the non-drive state.

2. The variable valve device for the internal combustion engine according to claim 1, wherein the switching portion includes:

a switching operation portion which is formed in the other body while having a cylinder and a piston, the cylinder being communicated with an oil passage of the rocker shaft, the piston being slidably inserted into the cylinder; and an abutment which is formed in one of the bodies while being able to abut on the piston by the slide of the piston, and a sleeve made of the iron-based metal material is provided in an inner surface of the cylinder.

3. The variable valve device for the internal combustion engine according to claim 2, wherein the different material is a non iron-based metal material.

4. The variable valve device for the internal combustion engine according to claim 3, wherein the non iron-based metal material is an aluminum material.

5. The variable valve device for the internal combustion engine according to claim 1, wherein the cylinder extends in a direction substantially perpendicular to the rocker shaft.

6. The variable valve device for the internal combustion engine according to claim 1, wherein the valve drive rocker includes:

a boss which is rotatably supported by the rocker shaft on both sides in which the cam follower rocker is located therebetween;

a pair of rocker arms wherein the arms extend linearly from the boss to the valve; and a connecting arm which connects the arms at end portions of the extended arms.

7. The variable valve device for the internal combustion engine according to claim 6, wherein the switching portion is able to switch a displacement of the cam follower rocker between transmission to the valve drive rocker and non-transmission to the valve drive rocker, and a part of the switching portion on the valve drive rocker side is provided in the connecting arm.

8. The variable valve device for the internal combustion engine according to claim 7, wherein the switching portion includes:

a switching operation portion which has a cylinder and a piston, the cylinder being communicated with an oil passage provided in the rocker shaft, the piston being slidably inserted into the cylinder; and an abutment which is able to abut on the piston by the slide of the piston wherein one of the switching operation portion and the abutment is provided in the connecting arm.

9. A variable valve device for an internal combustion engine, the device comprising:

a camshaft which is rotatably provided in an internal combustion engine while having a cam;

a rocker shaft which is arranged next to the camshaft;

a valve driven by the cam;

a cam follower rocker which is rotatably provided in the rocker shaft, and is rocked by following the cam;

a valve drive rocker which is rotatably provided in the rocker shaft next to the cam follower rocker, and drives the valve, either a body of the cam follower rocker or a body of the valve drive rocker is made of an iron-based metal material, and the other body is made of a material different from the iron-based metal material, heat treatment being not required in the different material;

a switching portion which be able to switch the valve drive rocker between a drive state and a non-drive state, wherein the valve drive rocker includes:

a boss which is rotatably supported by the rocker shaft on both sides in which the cam follower rocker is located therebetween;

a pair of rocker arms comprising the arms extend linearly from the boss to the valve; and a connecting arm which connects the arms at end portions of the extended arms.

10. The variable valve device for the internal combustion engine according to claim 9, wherein the switching portion is able to switch a displacement of the cam follower rocker between transmission to the valve drive rocker and non-transmission to the valve drive rocker, and a part of the switching portion on the valve drive rocker side is provided in the connecting arm.

11. The variable valve device for the internal combustion engine according to claim 10, wherein the switching portion includes:

a switching operation portion which has a cylinder and a piston, the cylinder being communicated with an oil passage provided in the rocker shaft, the piston being slidably inserted into the cylinder; and an abutment which be able to abut on the piston by the slide of the piston, and one of the switching operation portion and the abutment is provided in the connecting arm.

* * * * *